United States Patent [19]

Brunette

[11] 3,947,983

[45] Apr. 6, 1976

[54] RESISTANT TAG STRUCTURE

[76] Inventor: Jerome J. Brunette, 911 Cambridge Drive, Libertyville, Ill. 60048

[22] Filed: June 4, 1975

[21] Appl. No.: 583,607

[52] U.S. Cl. ..... 40/27; 40/2 R; 282/11.5 A; 428/285

[51] Int. Cl.[2] ..... G09F 3/02

[58] Field of Search ..... 40/2 R, 2.2, 21 R, 27, 40/135; 282/11.5 A, 11.5 R; 206/460, 820, 807; 428/285, 280, 284, 286, 287, 288

[56] References Cited

UNITED STATES PATENTS

| | | | |
|---|---|---|---|
| 2,311,860 | 2/1943 | Otis | 282/11.5 A |
| 2,768,460 | 10/1956 | Northrup | 40/135 |
| 2,961,365 | 11/1960 | Sroog | 428/285 |
| 3,757,936 | 9/1973 | Lindegren | 40/21 R X |
| 3,828,454 | 8/1974 | Hafner et al. | 40/27 |

*Primary Examiner*—Louis G. Mancene
*Assistant Examiner*—John F. Pitrelli
*Attorney, Agent, or Firm*—Dawson, Tilton, Fallon & Lungmus

[57] ABSTRACT

A resistant tag structure which includes a laminate of a thin metal foil and a web of high density self-bonded spun polyethylene fibers, the laminate being generally rectangular and having a web face equipped with printed indicia for the receipt of tag information, as by carbon imprinting.

7 Claims, 1 Drawing Figure

Fig. 1
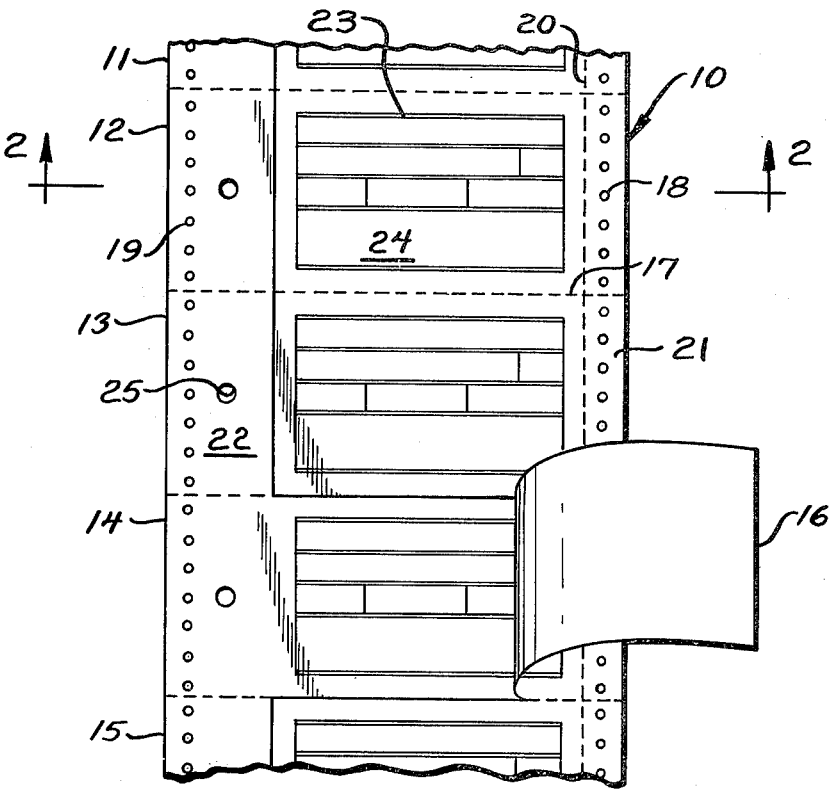
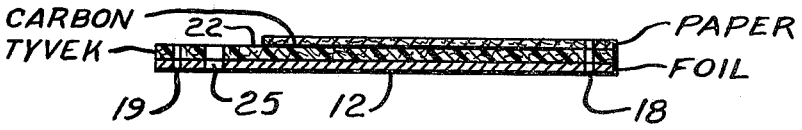
Fig. 2

RESISTANT TAG STRUCTURE

BACKGROUND AND SUMMARY OF INVENTION

This invention relates to a resistant tag structure and, more particularly, to a tag having exceptional resistance to the effects of weather, high temperatures, process baths, and age. In one preferred embodiment, the tag is adapted to be prepared on computer printers and other business print out machines.

Although there has been continuing work over the years to provide a suitably resistant tag (see for example the background set out in U.S. Pat. No. 3,828,454), there is still a need for tag that can be used to identify products while the products are exposed to extremes of temperature, weather, rough handling in processing, and during long periods of outdoor storage. There is also a need for tags used in the manufacture of textiles or other materials while the material is processed through hot dying vats and the like as well as long periods of both outdoor storage of raw materials and indoor storage of finished goods, and goods in process. Even further, there is an increasing need for tags that cannot only withstand these extreme requirements but can also be prepared by computer printers and office print out machines.

To meet this multi-faceted need, several approaches were taken. Sometimes steel tags were used. The steel was electrogalvanized and coated to resist corrosion and to accept painting and imprinting. The tag was marked by embossing or by handwriting with suitable ink or paint. This type of tag was not suitable for use in most printing devices because of its stiffness and the unsuitability of the surface for accepting ink from an ink ribbon. Further, it was not suited for systems where more than one tag was to be prepared at one time or where other business forms are to be prepared at the same writing with the tag.

Another approach has been to use a paper-like plastic material such as the material preferred in the use of the instant invention being a spun bonded olefin marketed under the trademark Tyvek by E. I. du Pont de Nemours & Co. This is a strong material with a heat resistance in the range of 200°–250°F. and an outdoor exposure life of approximately six months — thus, constituting a substantial improvement over common paper tags but the limits to heat and exposure were not sufficient for many applications in the steel and textile industries described above. Also, such spun bonded olefin tags have a tendency to curl and uncurl with humidity changes and tend to become brittle in time which leads to their destruction.

Another approach to the above problem has been the use of foil tags. This was an attempt to gain the strength and durability of metal with some of the ease of handling of paper tags. These tags have disadvantages in that they do not readily accept print out information from typewriter or computer print out mechanisms. Also, the foil must be relatively thick to have suitable stiffness. This thickness leads to high cost, difficulty in handling the print out mechanism and sharp edges. These inherent qualities make them very difficult to make as a continuous business form suited to computer print out.

Still another approach has been to first prepare a paper tag on the computer and then laminate it, either on both sides to enclose it in a plastic shield or to a more substantial backing material. This requires an additional operation in the prepartion of the tags which results in time delays, and errors in recollating the tag with other business papers that are to accompany the tag in the normal office procedures.

It is a principal object of this invention to prepare a tag that meets the requirements of commerce and industry today, yet avoids the deficiencies of the previously mentioned approaches i.e., a tag made of a laminate material which has suitable resistance to extremes of weather, temperature, process baths and age, yet can be prepared readily on office print out equipment and does not require additional protection or other operations in its preparation or use. This is achieved according to the instant invention by providing a laminate of a metal foil and a web of high density, self bonded spun polyethylene fibers each approximately 0.0002 inch in diameter, the web face of the laminate being equipped with printed indicia for the receipt of tag information. This results in a tag which is capable of resisting the extreme conditions heretofore mentioned and which is peculiarly adapted for imprinting on computer printers and other business print out machines.

DETAILED DESCRIPTION

The invention is described in conjunction with an illustrated embodiment in the accompanying drawing, in which FIG. 1 is a fragmentary perspective view of a tag structure embodying teachings of this invention; and FIG. 2 is a sectional view taken along the sight line 2—2 applied to FIG. 1.

In the illustration given, the numeral 10 designates generally a tag structure embodying teachings of this invention and is seen to include a series of connected tags 11, 12, 13 and 14 and 15, each of which is identical to the rest. Taking as illustrative the tag 12 (which is seen in section in FIG. 2), it is seen that on one face, the tag 12 has a foil layer which is laminated to a layer of high density, self bonded spun polyethylene fiber each approximately 0.0002 inch in diameter. The lamination is advantageously achieved through the use of heat, pressure, and a suitable adhesive. Such laminates, according to one preferred form of the invention, are made in elongated continuous strips and are overlaid with an elongated strip of carbonized paper as at 16 relative to the tag 14. The superposed laminate and carbonized paper strips are transversely perforated along longitudinally spaced apart, transversely extending lines as at 17 between the tags 12 and 13 in FIG. 1. Additionally, the superposed strips are line hole punched as at 18 (still referring to FIG. 1, see the upper right hand portion thereof).

Still further, the laminate of foil and spun bonded polyethylene is line hole punched as at 19 along the other longitudinal edge. The combination of the line holes 18 and 19 facilitate processing of the tag structure 10 through computer printers or other business forms equipment. In the illustration given, the upper ply 16 is intended to be retained as an office copy and for that purpose, the strip constituting the paper layer may be advantageously perforated along a longitudinal line as at 20 prior to being adhered to the plastic layer in the area between the right hand longitudinal edge and the longitudinal edge of perforation 20, i.e., the area 21. This makes for ready detachment of the paper layer 16 after the tag information has been applied.

For this purpose, I provide imprinted indicia both on the ply 16 and the plastic layer 22 (see the central portion of FIG. 1). The printing is advantageously achieved prior to adhering the paper strip to the laminate, utilizing the line holes 18 to achieve proper registration. It will be appreciated that a plurality of plies 16 may be utilized in the practice of the invention so as to provide a number of copies of the tab information for mailing, filing, or other business purposes.

In the use of the form of the invention illustrated, the tag structure 10 is normally provided in fan-folded form, i.e., zigzag folded for normal computer printer processing. As the continuous form is stepped through the computer printer, utilizing the line holes 18 and 19 as advancing means (usually cooperating with pin belts), the information concerning the article to be tagged (not shown) is printed onto the paper ply 16 and within the space provided by the prior printed indicia 23. This can include not only the identity of the article, its processing or handling conditions but also other valuable information such as the ultimate recipient whose name and address can be applied in the larger blank space 24 defined by the printed indicia 23. Thereafter, the continuous form can be burst, i.e., transversely separated along the perforation line 17 to provide individual tags, each having one or more office copies in the form of the paper plies 16. The paper plies 16 are then removed after which the tag is available for application to the article being processed or otherwise handled.

In the event the tagging is to be achieved through a conventional wire, I provide an eyelet or hole 25 along the left hand margin in which the wire (not shown) can be reeved and thereafter secured to the article to be processed. In some cases, it may be desirable to provide a grommet about the opening 25 but this embellishment is normally not needed inasmuch as the laminate of foil and Tyvek has a strong resistance to tearing at the opening 25. This is advantageously achieved by combining the added strength due to plastic fibers which give high tear resistance and the high tensile strength of the foil. Optimally, the foil is aluminum having a thickness in the range of 0.001 to about 0.010 inch with the spun bonded polyolefin having a thickness of from about 0.004 to about 0.010 inch.

This combination also achieves resistance to high heat due to the physical protection afforded the foil laminate by the inherent high temperature resistance of the foil layer itself and the mechanical support it lends to the plastic while the latter is in a somewhat weakened condition.

Further, the inventive tag structure has effective resistance to dying baths by means of resistance to fluid absorption by the foil on the one side and the plastic fiber material on the other which is mechanically supported by the foil at the times when the plastic could be weak due to temperature and conditions of liquefaction.

The inventive laminate further achieves the objective of being a versatile tag structure by its resistance to curling due to the impervious nature of the foil, the stiffness of the foil and the low moisture absorption of the plastic material.

Besides all of these advantageous physical characteristics, the inventive tag structure can also accept an original image from an ink ribbon system or can accept an image as the second, third, fourth, etc. ply of a multiple ply business form by means of the permanent nature of the image formed on the polyolefin surface of the tag from self contained-image transfer papers such as Frye Hi-Mark papers. Such transfer papers are capable of tranferring an image to an uncoated sheet of paper, olefin, etc., as contrasted to image transfer systems of the NCR type where the coating on the top of one sheet cooperates with the coating on the bottom of the sheet above to develop the desired image. Such self contained-image transfer papers are preferred for the sheet 16 although it is possible to use certain permanent image producing carbon coatings on the back of the sheet 16, or, in certain instances separate carbon sheets, and by the term "carbon sheet," I intend to include the various image producing means described herein.

I claim:

1. A tag structure adapted to receive handling information and retain the same under adverse weather and processing conditions comprising a laminate of a thin metal foil on a web of high density, self bonded spun polyethylene fibers each approximately 0.0002 inch in diameter, said laminate being generally rectangular and having a web face and a foil face, printed indicia on said web face for the receipt of information concerning an article to be tagged, said laminate being perforable without tearing thereof.

2. The tag structure of claim 1 in which said laminate is equipped with at least one hole extending therethrough.

3. The tag structure of claim 2 in which said laminate is an elongated strip having a plurality of equally spaced lines of perforations to provide a series of connected legs separatable along said lines, and a plurality of aligned holes along each longitudinal edge of said strip.

4. The structure of claim 3 in which a carbon sheet is attached to said laminate along one longitudinal edge of said strip.

5. A tag structure comprising an elongated assembly of connected tags defined by lines of cross perforation and adapted to be zigzag folded, said elongated tag structure comprising a laminated ply having a foil layer integrated to a plastic layer, said plastic layer consisting of high density, self bonded spun polyethylene fibers each approximately 0.0002 inch in diameter, at least one carbon sheet ply overlying said laminate ply, each of said plies being equipped with printed indicia for the receipt of information concerning an article to be tagged, and aligned holes along the longitudinal edges of said tag structure to provide feeding means for advancing the same through a business form printer.

6. The structure of claim 5 in which said carbon sheet ply has a carbonized face in confronting relation to said plastic layer.

7. The structure of claim 5 in which said carbon sheet ply is constructed of self-contained image transfer paper.

* * * * *